US005662247A

United States Patent [19]

Rapchak et al.

[11] Patent Number: 5,662,247

[45] Date of Patent: Sep. 2, 1997

[54] TAMPER EVIDENT PUSH PULL RESEALABLE CAP

[75] Inventors: Thomas P. Rapchak; Michael Marino, both of New Castle, Pa.

[73] Assignee: West Penn Plastics, New Castle, Pa.

[21] Appl. No.: 616,367

[22] Filed: Mar. 15, 1996

Related U.S. Application Data

[63] Continuation-in-part of Ser. No. 536,623, Sep. 28, 1995.

[51] Int. Cl.[6] ..... B67D 5/33

[52] U.S. Cl. ..... 222/153.07; 222/153.1; 222/525

[58] Field of Search ..... 222/153.07, 153.1, 222/153.14, 153.06, 525, 541.6, 541.9, 568, 570; 215/253, 256

[56] References Cited

U.S. PATENT DOCUMENTS

| | | | |
|---|---|---|---|
| 4,500,016 | 2/1985 | Funfstuck . | |
| 4,561,553 | 12/1985 | Crisci . | |
| 4,589,561 | 5/1986 | Crisci . | |
| 4,746,035 | 5/1988 | Anderson et al. | 222/153.1 |
| 4,779,764 | 10/1988 | Debetencourt . | |
| 4,801,032 | 1/1989 | Crisci . | |
| 4,805,807 | 2/1989 | Perne et al. . | |
| 4,948,003 | 8/1990 | Munoz . | |
| 5,104,008 | 4/1992 | Crisci . | |
| 5,328,063 | 7/1994 | Beck et al. | 222/525 |
| 5,507,416 | 4/1996 | Rapchak et al. | 222/525 |

*Primary Examiner*—Philippe Derakshani
*Attorney, Agent, or Firm*—Harpman & Harpman

[57] ABSTRACT

A tamper evident resealable cap for use on a bottle, the cap having an upstanding spout that is registerable with an opening in the center of the cap and a sealing plug of a smaller diameter positioned thereabove on multiple upstanding legs extending from the spout. An over cap extends over the spout, enclosing the spout with a tamper evident enclosure. The improvement is directed towards a detachable annular ring secured to the over cap by a plurality of frangible elements thereabout, the ring is arranged for restrictive registration with a locking shoulder that extends from the top of the cap body. The cap body has a tamper evident tear band extending from the cap with a frangible tear line therein. A tear tab extends from the tear band for selective engagement by the user to remove the tear band.

12 Claims, 3 Drawing Sheets

TAMPER EVIDENT PUSH PULL RESEALABLE CAP

This is a continuation in part patent application of Ser. No. 08/536,623, filed Sep. 28, 1995.

BACKGROUND OF THE INVENTION

1. Technical Field

This device relates to tamper evident closures for use on containers. This improvement relates to resealable push pull type closures that provide resealable access to the contents of a bottle with a tamper evident indication of removal of the closure.

2. Description of Prior Art

Prior art devices of this type are related to tamper evident closures, see for example U.S. Pat. Nos. 4,948,003, 5,104,008, 4,500,016, 4,561,553, 4,589,561, 4,779,764, 4,801,032, and 4,805,807.

SUMMARY OF THE INVENTION

An improvement in a tamper evident resealable closure for bottles that require a push pull spout cap to have a tamper indicating over cap as well as a second tamper indicating band on the cap body registerable with the neck of the bottle. The improvement resides in the restriction of the tamper evident indicating over cap which must be removed to gain access to the pour spout cap.

DESCRIPTION OF THE PREFERRED EMBODIMENT

Figure 1:
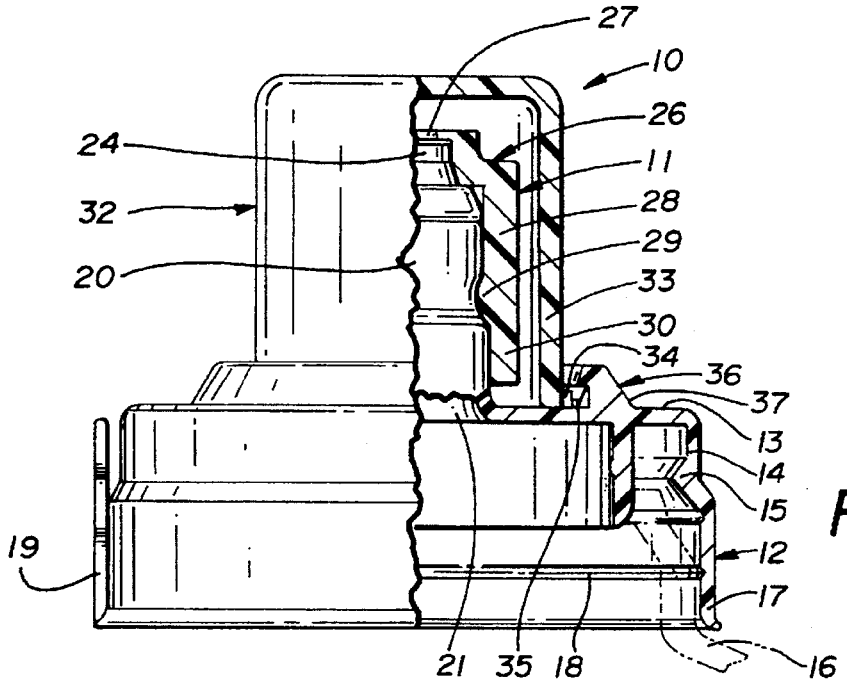
FIG. 1 is a partial cross-sectional view of a resealable bottle cap with portions broken away shown in closed position.
Figure 2:
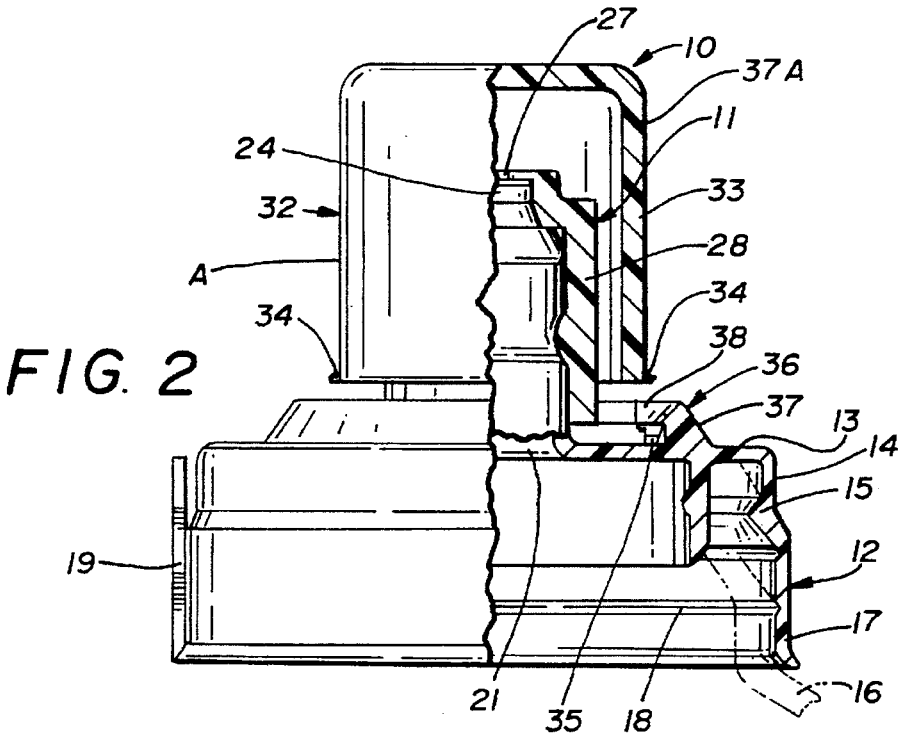
FIG. 2 is a partial cross-sectional view of a portion of the resealable bottle cap with pour spout cap and over cap in partial open position.
Figure 3:
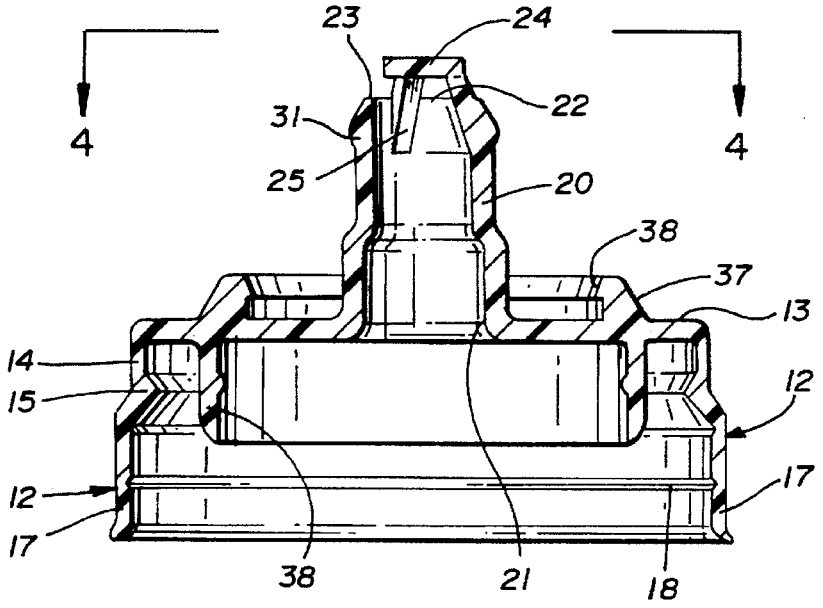
FIG. 3 is a cross-sectional view of the pour spout base of the invention.

Referring to FIGS. 1, 2, and 3 of the drawings, an improvement in a tamper evident resealable bottle cap 10 can be seen having a push pull closure 11 portion and a snap on tamper evident base portion 12. The base portion 12 comprising a lower top portion 13 having a downwardly depending annular flange 14 extending therefrom defining a first tamper evident skirt.

The annular depending flange 14 has an inturned annular retaining bead 15 extending therefrom in spaced relation to the lower top portion 13 for registration onto a bottle neck 16 shown in broken lines.

A tear band 17 extends from the annular depending flange 14 defined therefrom by a frangible tear line 18 of reduced transverse dimension as is typical in the art. A tear tab 19 extends from the tear band 17 providing a removal point that in operation can be selectively engaged by the user for removal of the tear band 17, if desired and to provide indication of tampering of the container on which the cap 10 of the invention is secured.

Referring again to FIGS. 1 and 2 of the drawings, it will be seen that the lower top portion 13 has an upstanding cylinder pour spout 20 extending from the center thereof. An opening 21 is formed in the center of the lower top portion 13 in registration with the cylindrical pour spout 20. Apertures are formed at 22 within the upper end of the pour spout 20 defining a secondary top portion 23. A closure plug 24 is positioned on the secondary top portion 23 in spaced relation above the apertures 22 by a plurality of circumferentially spaced upwardly and angularly extending legs 25.

The push pull top cap 11 positioned on the cylindrical pour spout 20 has an upper portion 26 with a central opening 27 therein which registers with the closure plug 24 forming a secondary closure when the top cap 11 is in closed position, best seen in FIG. 1 of the drawings. The top cap 11 when in closed position rests on the lower portion 13 of the cap base portion 12.

The top cap 11 has an engageable annular flange 28 depending from the upper top portion 26. The flange 28 has a single inturned annular flange 29 which defines a transition area of decreased transverse dimension at 30 therefrom. The cylindrical pour spout 20 has an outwardly extending annular flange 31 adjacent to its free upper end which slideably engages the inner surface of the engageable annular flange 28 above the single internal annular flange 29.

The improvement comprises an over cap 32 positioned in spaced relation on the cylindrical pour spout 20. The over cap 32 has a depending annular body flange 33 having a plurality of annularly spaced frangible elements 34 extending from its lower perimeter edge interconnecting a tamper indicating ring 35. The tamper indicating ring 35 is of a larger diameter than that of the depending annular body flange 33 and rests on the top portion 13. An upstanding segmented locking shoulder 36 extends from and is integral with the lower top portion 13 centrally thereabout and in spaced relation to the upstanding pour spout 20. The segmented locking shoulder 36 has a tapered outer surface 37 and an inwardly extending locking flange 38 registerable over the hereinbefore described tapered tamper indicating ring 35, best seen in FIGS. 1 and 2 of the drawings.

In assembled form, as illustrated in FIGS. 1 and 2 of the drawings with the tamper indicating ring 35 is interconnected to the annular body flange 33 of the over cap 32 by the frangible elements 34 so that the over cap 32 cannot be removed due to the registration of the tamper indicating ring 35 with the locking shoulder 36 thus restricting the access to the pour spout 11.

To remove the over cap 32, the user grips the opposing outer surfaces of the annular body flange 33 moving same upwardly and away from the lower top portion 13 as illustrated in FIG. 2 of the drawings until sufficient force is imparted to the over cap 32 to break the frangible elements 34. With the over cap 32 free of the tamper indicating ring 35, it can be removed.

The tamper indicating ring 35 remains under the segmented locking shoulder 36 on the lower top portion 13 of the cap base portion 12. The top cap 11 can then be moved vertically opening the pour spout 20 allowing access to the container as will be well understood by those skilled in the art.

Figure 4:
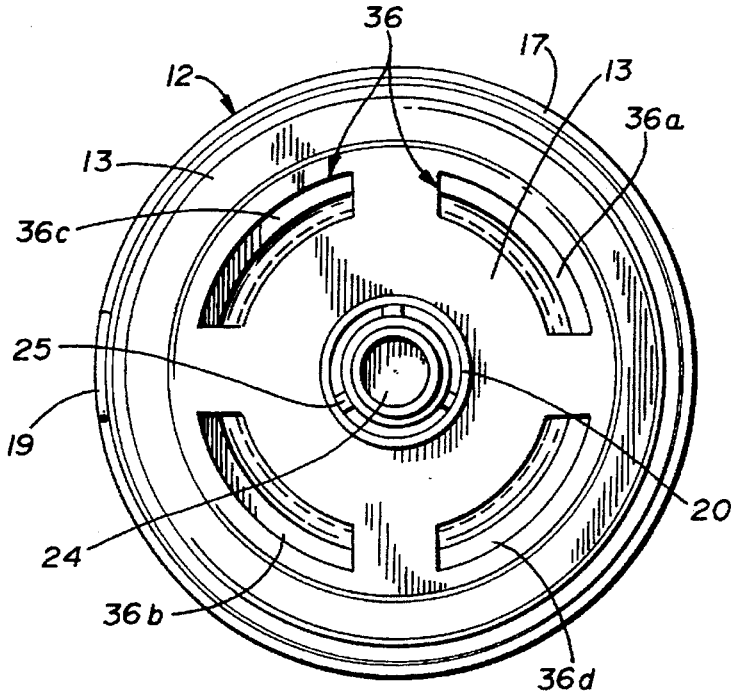
FIG. 4 is a top plan view of the pour spout base on lines 4—4 of FIG. 3.
Figure 5:
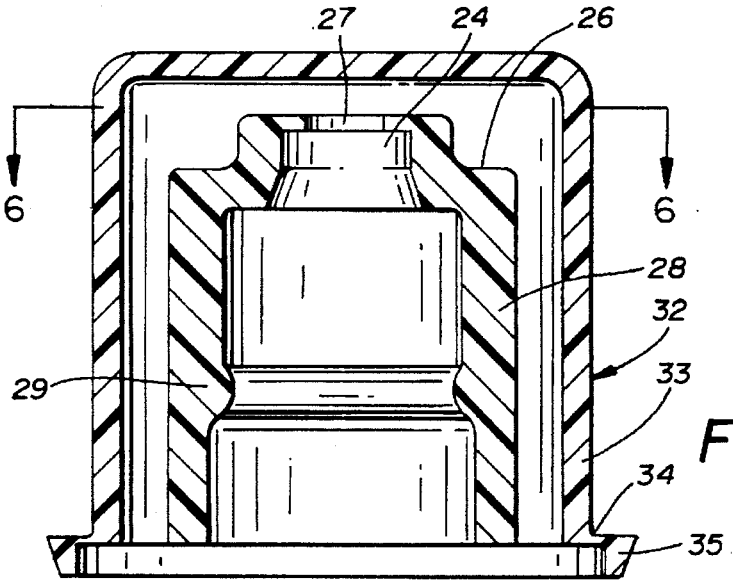
FIG. 5 is a cross-sectional view of the cap and over cap portion of the pour spout.
Figure 6:
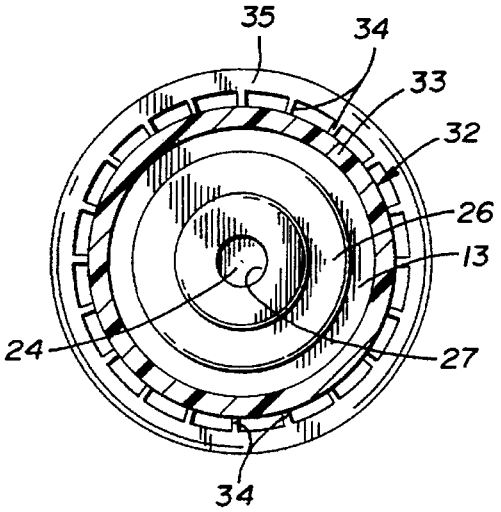
FIG. 6 is a top plan view on lines 6—6 of FIG. 5.

Referring now to FIG. 4 of the drawings, the segmented locking flange 36 is divided into four oppositely disposed arcuate sections 36A, 36B, 36C and 36D so as to equally register with corresponding portions of the tamper indicating ring 35 illustrated in FIG. 6 of the drawings.

Referring to FIG. 3 of the drawings, the base portion 12 has an annular sealing flange 38 depending therefrom inwardly from its lower top portion 13 opposite the inturned annular depending flange 15.

Figure 7:
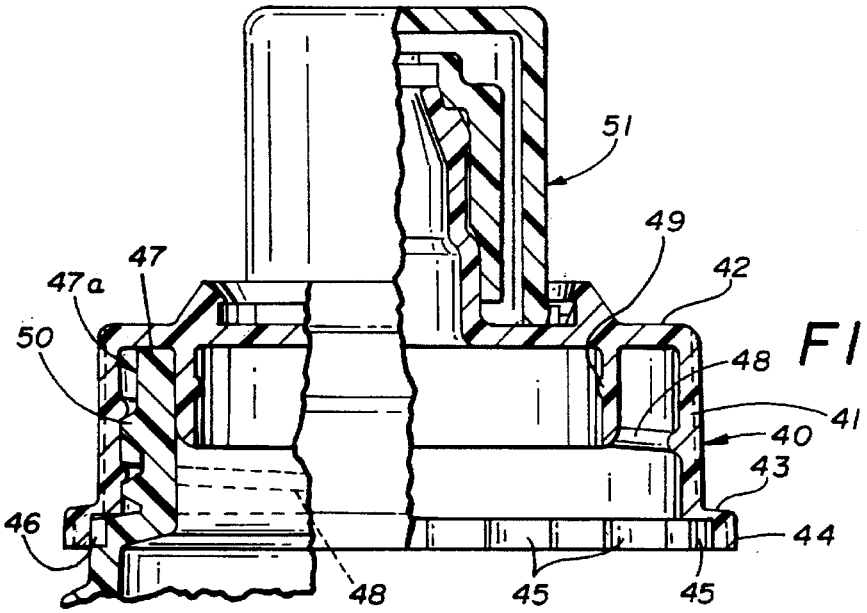
FIG. 7 is a composite cross-sectional view on an alternate resealable bottle cap shown in closed position.

Referring now to FIG. 7 of the drawings, an alternate cap form of the invention can be seen defining a screw on tamper evident base portion 40 having an annular flange 41 depending from a top portion 42. A plurality of radially extending circumferentially spaced frangible elements 43 extend from the lower perimeter edge of the flange 41 interconnecting an annular tamper evident ring 44 thereto. The annular tamper evident ring 44 is of a larger diameter than the depending annular flange 41, and has a plurality of circumferentially spaced inwardly facing projections 45. Each of the projections 45 is angularly inclined about the inner surface of the ring 44 and are so positioned that they incline in a counterclockwise direction for selective registration with corresponding ratchet teeth 46 extending outwardly from the a portion 47 of a container 47A.

A single spiral thread 48 extends from the inner surface of the integral depending annular flange 41 beginning opposite an annular sealing flange 49 just below the lower top portion 42 and terminating above the tamper indicating ring 44 as will be well known and understood by those skilled in the art.

The spiral thread 48 is in registering cooperation with a spiral thread 50 on the exterior of the neck portion 47 shown in FIG. 7 of the drawings.

A push pull closure and over cap configuration 51 is formed within the alternate cap and is identical to the top cap 11, pour spout 20 and over cap 32 configurations hereinbefore described and illustrated in FIGS. 1–6 of the drawings.

It will thus be seen that an improvement to a push pull resealable tamper evident closure has been illustrated and described and it will be apparent to those skilled in the art that various changes and modifications may be made thereto without departing from the spirit of the invention.

Therefore I claim:

1. A tamper evident bottle cap for a bottle having a neck surrounding an opening, the neck having at least two vertical spaced annular securing flanges extending therefrom, the bottle cap comprising;

a. a lower top portion having a hole and a first annular flange extending from said lower top portion, the inside of said first annular flange having an annular retaining bead extending inwardly from said first annular flange;

b. a tear band going around said first annular flange, said tear band being connected integrally to a tear tab;

c. a spout being integrally connected to said lower top portion and being in communication with the hole in said lower top portion, said spout having an aperture therethrough;

d. a top cap being slideably movable on said spout, said top cap having an upper top portion and the upper top portion having an opening, the aperture in the spout being registerable with the opening in said upper top portion;

e. a plug extending from said spout and being registerable with the opening in the upper top portion thereby defining a closure when the top cap is in down position;

f. an over cap extending from said lower top portion in spaced vertical and horizontal relation to said spout; and g. a plurality of frangible elements extending from said over cap connecting a tamper indicating ring, a locking shoulder on said lower top portion being in spaced relation to said pour spout, said locking shoulder holding said tamper indicating ring on the lower top portion upon removal of said over cap.

2. The bottle cap of claim 1 wherein the lower top portion further comprises an annular sealing flange and wherein said locking shoulder includes an inwardly extending locking flange.

3. The bottle cap of claim 1 wherein said locking shoulder is segmented into oppositely disposed pairs of annular spaced arcuate sections.

4. The bottle cap of claim 1 wherein said over cap has a closure body flange being in spaced relation with said spout, the closure body flange attached to said frangible elements.

5. The bottle cap of claim 1 wherein said top cap has an engageable annular flange to stop the vertical movement on said spout.

6. The bottle cap of claim 5 wherein said spout has a tubular body of a known outer diameter and said engageable annular flange of said top cap has an inner diameter which is greater than said outer diameter of said tubular body.

7. A tamper evident bottle cap for a bottle, the bottle having a neck with a spiral thread and an opening, the bottle cap comprising;

a. a lower top portion having a hole and a first annular flange extending from said lower top portion, the inside of said first annular flange having a spiral thread;

b. a first tamper evident ring being attached to the first annular flange;

c. a spout being integrally connected to said lower top portion and being in communication with the hole in said lower top portion, said spout having an aperture therethrough;

d. a top cap being slideably removable on said spout, said top cap having an upper top portion and the upper top portion having an opening, the aperture in the spout being registerable with the opening in said upper top portion;

e. a plug extending from said spout and being registerable with the opening in the upper top portion thereby defining a closure when the top cap is in a down position;

f. an over cap movably secured to said lower top portion and extending in spaced vertical and horizontal relation about said top cap; and g. a plurality of frangible elements extending from said over cap connecting a second tamper indicating ring, a locking shoulder on said lower top portion being in spaced relation to said pour spout, the locking shoulder engageable on second tamper indicating ring.

8. The bottle cap of claim 7 wherein the lower top portion further comprises an annular sealing flange and wherein said locking shoulder includes an inwardly extending locking flange.

9. The bottle cap of claim 7 wherein said locking shoulder is segmented into oppositely disposed pairs of annularly spaced arcuate sections.

10. The bottle cap of claim 7 wherein said top cap has a closure body flange being in spaced relation to said spout.

11. The bottle cap of claim 7 wherein said top cap has an engageable annular flange to stop the vertical movement of said top cap on said spout.

12. The bottle cap of claim 11 wherein said spout has a tubular body of a known outer diameter and said engageable annular flange of said top cap has an inner diameter which is greater than said outer diameter of said tubular body.

* * * * *

UNITED STATES PATENT AND TRADEMARK OFFICE

CERTIFICATE OF CORRECTION

PATENT NO. : 5,662,247

DATED : September 2, 1997

INVENTOR(S) : Thomas P. Rapchak, Michael Marino

It is certified that error appears in the above-identified patent and that said Letters Patent is hereby corrected as shown below:

Column 4, line 33 erase "removable" and insert ---movable---

Signed and Sealed this

First Day of September, 1998

Bruce Lehman

*Attest:*

BRUCE LEHMAN

*Attesting Officer*

*Commissioner of Patents and Trademarks*